US005118203A

United States Patent [19]

Andronico

[11] Patent Number: 5,118,203

[45] Date of Patent: Jun. 2, 1992

[54] RESEALABLE PACKAGES AND METHOD AND APPARATUS FOR PRODUCING SAME

[75] Inventor: David J. Andronico, Quincy, Mass.

[73] Assignee: T W Kutter, Inc., Avon, Mass.

[21] Appl. No.: 687,821

[22] Filed: Apr. 19, 1991

[51] Int. Cl.[5] ..... B65D 33/16

[52] U.S. Cl. ..... 383/61; 383/35; 383/210; 383/94

[58] Field of Search ..... 383/5, 35, 61, 63, 94, 383/210, 211; 206/632, 633

[56] References Cited

U.S. PATENT DOCUMENTS

| | | | |
|---|---|---|---|
| 2,991,001 | 7/1961 | Hughes . | |
| 3,471,005 | 10/1969 | Sexstone | 206/632 X |
| 3,473,589 | 10/1969 | Gotz . | |
| 3,604,616 | 9/1971 | Greif | 206/632 |
| 3,724,651 | 4/1973 | Link | 206/633 X |
| 3,780,781 | 12/1973 | Uramot . | |
| 3,815,317 | 6/1974 | Toss . | |
| 3,854,653 | 12/1974 | Engelsberger | 206/633 |
| 4,203,520 | 5/1980 | Schuster | 383/94 X |
| 4,240,241 | 12/1980 | Sanborn, Jr. . | |
| 4,246,288 | 1/1981 | Sanborn, Jr. . | |
| 4,411,365 | 10/1983 | Horikawa et al. | 206/633 X |
| 4,437,293 | 3/1984 | Sanborn, Jr. . | |
| 4,471,875 | 9/1984 | Hain et al. | 206/632 |
| 4,572,377 | 2/1986 | Beckett . | |
| 4,617,683 | 10/1986 | Christoff . | |
| 4,637,063 | 1/1987 | Sullivan et al. | 383/61 |
| 4,698,954 | 10/1987 | Behr et al. . | |
| 4,782,951 | 11/1988 | Griesbach et al. . | |
| 4,966,470 | 10/1990 | Thompson et al. | 383/61 |
| 4,969,309 | 11/1990 | Schwarz et al. . | |
| 5,026,563 | 6/1991 | Van Erden et al. | 383/61 X |

FOREIGN PATENT DOCUMENTS

| | | | |
|---|---|---|---|
| 398731 | 11/1990 | European Pat. Off. | 383/61 |

*Primary Examiner*—Stephen Marcus
*Assistant Examiner*—Jes. F. Pascua
*Attorney, Agent, or Firm*—Fish & Richardson

[57] ABSTRACT

A resealable package having upper and lower webs defining a product containing area between them, the webs being permanently sealed to each other around the majority of the periphery of the product containing area and being temporarily and resealably sealed along the remainder of the periphery via a peelable seal between the two webs and an interlocking bead structure which effects an openable and reclosable seal between the two webs, the peelable seal being elongated and generally extending along a seal line and having a leading tear edge of reduced area so as to facilitate initiation of an opening along the peelable seal, the peelable seal being formed using a crowned seal heating plate.

5 Claims, 2 Drawing Sheets

RESEALABLE PACKAGES AND METHOD AND APPARATUS FOR PRODUCING SAME

BACKGROUND OF THE INVENTION

This invention relates to vacuum packages and vacuum packaging equipment, and particularly to a resealable package configuration and apparatus for producing same. Such packages are particularly useful for food products where the package is evacuated and hermetically sealed, and where the consumer wishes to reclose the package after breaking the hermetic seal.

Many food items, such as bacon, hot dogs, cheese, luncheon meat, etc., are sold in vacuum packages formed from flexible thermoplastic materials. The packages are evacuated and hermetically sealed, and in some cases gas flushed, to preserve the freshness of the product within the package. However, the consumer often does not use all of the product immediately, and may therefore want to reclose the package. It is undesirable for the consumer to have to entirely repackage the product in, for example, a cellophane or Saran (trademark) wrap or sealable bag. Many prior art package designs therefore offer means for resealing the package.

One such means involves the use of zipper-type resealable closure strips on the two inner surfaces of the package material. These closure strips consist of thermoplastic beads either extruded with or attached to the package materials. These beads have an interlocking profile. A number of patents have been issued for such packages in the past, including those briefly described below.

Patents issued in the past relating generally to resealable packages include, for example, the following U.S. Pat. Nos. 2,991,001; 3,473,589; 3,780,781; 3,815,317; 4,240,241; 4,246,288; 4,572,377; 4,437,293; 4,617,683; 4,698,954; 4,782,951.

Included in the above list are three United States patents assigned to W. R. Grace & Co., naming Sanborn, Jr., as inventor. U.S. Pat. Nos. 4,240,241 and 4,437,293 claim a method and apparatus for making a reclosable package. U.S. Pat. No. 4,246,288 claims the reclosable package itself. The reclosable package comprises an external peripheral seal and a reclosable seal on the interior side of one edge of the package. "Indentations" are punched out to remove a portion of zipper bead material in the region of the sealed area, though a central strip of material still remains.

U.S. Pat. No. 4,782,951 discloses a reclosable package having interlocking closure strips positioned outside of a hermetic seal. The hermetic seal is of the peelaway type so as not to destroy the integrity of the package upon opening of the package.

U.S. Pat. No. 4,969,309 (which is hereby incorporated by reference), describes a resealable package having an interlocking bead structure inside of a peelable seal on zipper closure material.

SUMMARY OF THE INVENTION

In one aspect, the invention features, in general, a resealable package made of two webs of plastic that are sealed to each other and employ an interlocking bead structure and a peelable seal that has a leading tear edge of reduced area so as to facilitate initiation of an opening along the peelable seal, permitting the use of a strong and reliable peelable seal that is easy to open.

In another aspect, the invention features, in general, using a crowned seal heating plate to provide a reliable peelable seal in a resealable package employing an interlocking bead structure.

In preferred embodiments the leading tear edge is a point, and there are a plurality of leading tear edges extending along the peelable seal and providing a scalloped edge. The peelable seal is located outside of the interlocking bead structure. The interlocking bead structure is provided by two strips of zipper closure material that have been permanently sealed to respective webs, and the peelable seal is between the two strips. The seal heating plate used to make the peelable seal has a front wall with the crowned surface extending along it and has gently sloping surfaces extending from the crowned surface to points corresponding to the points of a scalloped edge.

Other advantages and features of the invention will be apparent from the following description of a preferred embodiment thereof and from the claims.

DESCRIPTION OF THE PREFERRED EMBODIMENT

The drawings will be described first.

DRAWINGS

STRUCTURE, MANUFACTURE AND USE

Figure 1:
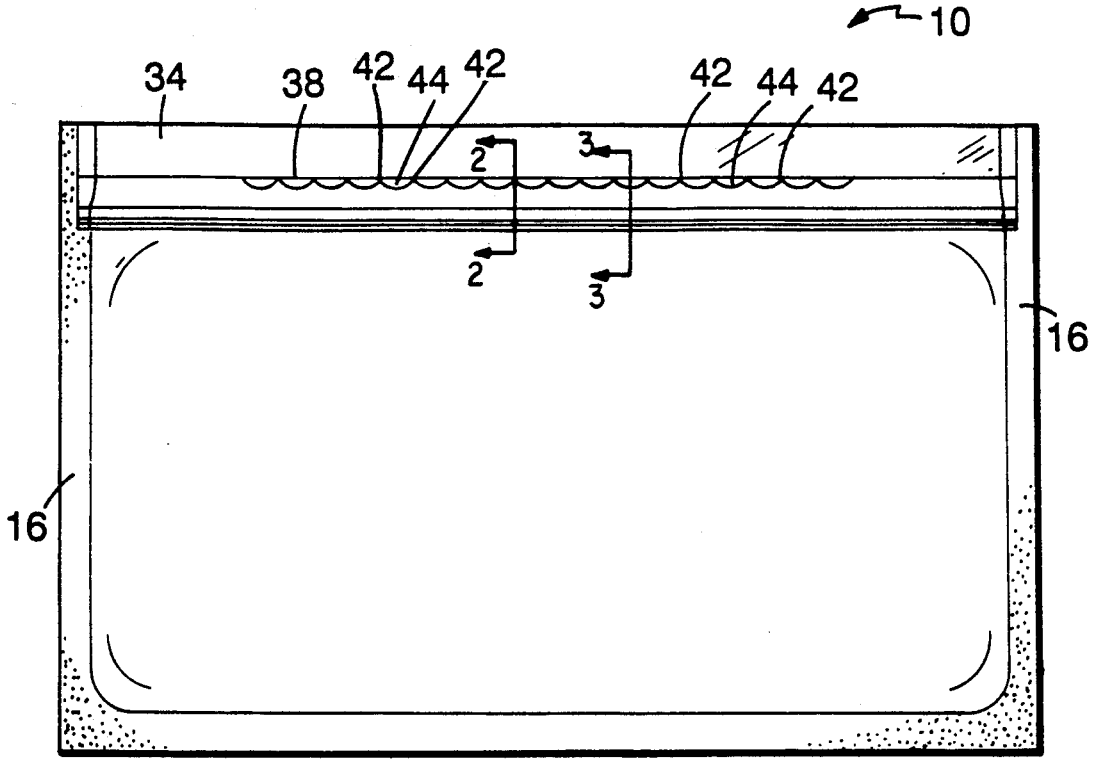
FIG. 1 is a plan view of a resealable package according to the invention.
Figure 2:
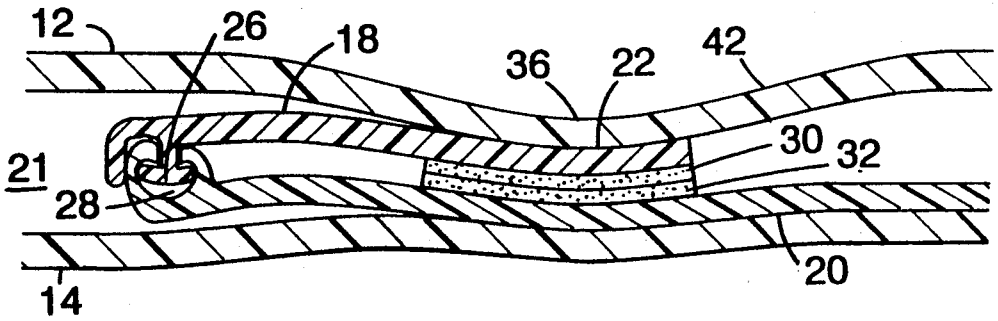
FIG. 2 is a diagrammatic sectional view, taken at 2—2 of FIG. 1, of a closable seal portion of the FIG. package.
Figure 3:
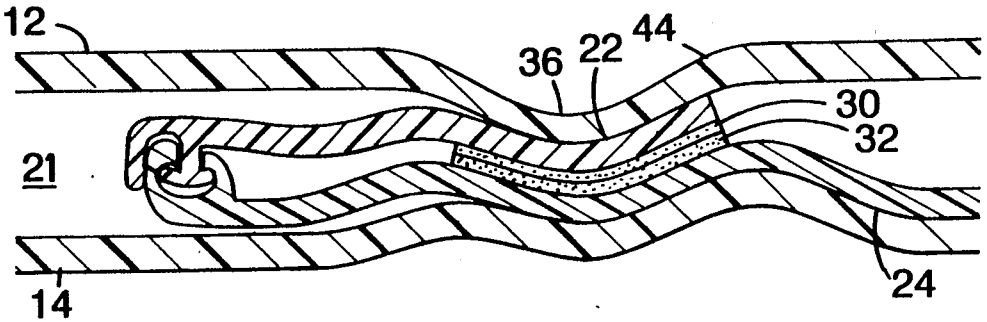
FIG. 3 is a diagrammatic sectional view, taken at 3—3 of FIG. 1, of the closable seal portion of the FIG. 1 package.

FIGS. 1-3 show resealable vacuum package 10 produced in accordance with the invention. Package 10 includes upper and lower plastic webs 12 and 14, respectively, hermetically sealed around three sides of their periphery by continuous sealed area 16 and resealably closed at the fourth side by zipper-type closure strips 18, 20 to provide enclosed product containing area 21. Webs 12, 14 are made of a coextruded sheet having nylon, polyethylene and PVDC layers, permitting deep forming at product containing area 2!. Other material could, of course, be used. Strips 18, 20 are sealed at permanent seal areas 22, 24 to upper web 12 and lower web 14, respectively. Zipper bead 26 on strip 18 and mating slot 28 on strip 20 are positioned inside the peelable seal between sealant layers 30, 32 of each resealable closure strip. Strips 18, 20 run from preferably just within sealed area 16 at one edge of the package to preferably just within sealed area !6 at the opposite edge of the package, but, in any event, strips 18, 20 do not pass fully through sealed area 16. Sealed area !6 extends beyond strips 18, 20 to open end 34 of package 10.

Generally, strips 18, 20 may be any suitable reclosable zipper material approved for food use, such as FRESH-TRAK (trademark) reclosable zippers supplied by Presto Products Company of Appleton, Wis., United States of America. Such zipper material conventionally has interlocking plastic beads of various configuration, is made of polyethylene (though other materials can be used), carries sealant layers 30, 32, and is supplied with the two strips 18, 20 joined together on rolls.

The seal between layers 30, 32 is at reduced-thickness region 36, which results from the application of heat and pressure during the sealing operation. The reduced thickness region has a scalloped outside edge 38 (FIG. 1), which has a plurality of reduced-area (i.e., pointed) leading tear edges 42, used to facilitate opening of the peelable seal. The reduced-thickness portion of a leading tear edge 42 is shown in FIG. 2. The reduced-thickness portion of a valley 44 between tear edges 42 is shown in FIG. 3. (FIGS. 2 and 3 are not drawn to scale.)

Figure 4:
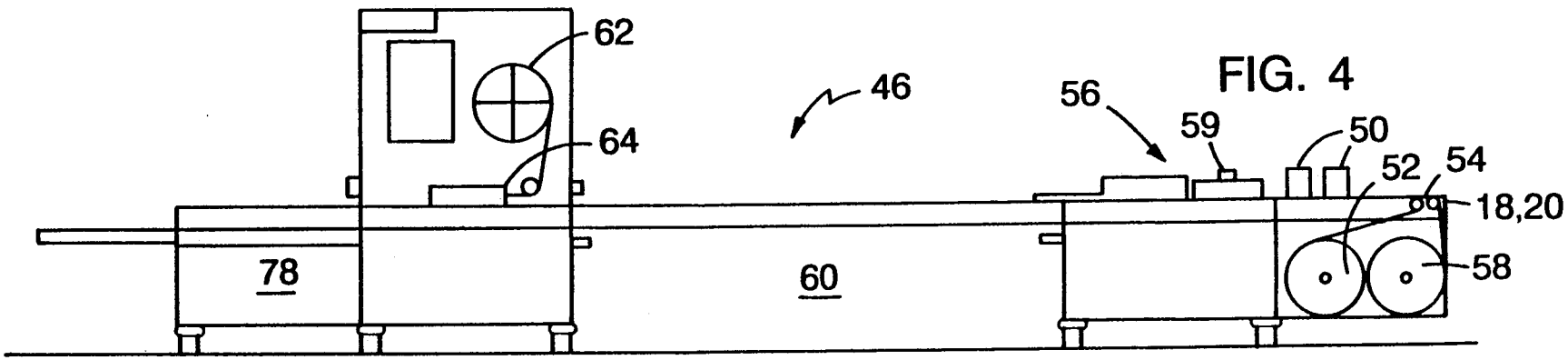
FIG. 4 is a diagrammatic side elevation of form, fill and seal apparatus for making the FIG. 1 package.

FIG. 4 shows, in schematic form, equipment 46 used to produce packages !0. With the exception of a modification to seal heating plate 48 shown in FIGS. 5 and 6, equipment 46 is as described in U.S. Pat. No. 4,969,309. The equipment employed is a Tiromat 3000 horizontal form fill and seal vacuum packaging line manufactured and sold by Kramer & Grebe Canada Ltd., of Waterloo, Ontario, Canada that has zipper application assembly 50 added to it. The zipper application assembly can be adapted to most vacuum packaging machines. It applies the zipper before the conventional operations of forming, filling and sealing the packages. The forming and filling of the packages takes place exactly as in the prior art. The lower web material 14 is fed in conventional fashion from roll 52, passing around spring-arm mounted tensioning roller 54, and is vacuum formed in conventional fashion to produce an open container at vacuum forming station 56. However, before entering the vacuum forming station, the apparatus applies zipper strips 18, 20 received from roll 58 at applying station 50 and seals strip 20 to web 14 at permanent seal area 24 at zipper sealing mechanism 59. After vacuum forming, the container is filled in conventional fashion in the loading zone 60. The upper web material 12 is then fed from roll 62 and hermetically sealed to the lower web 14 at the vacuum sealing station 64, resulting in sealed area 16. At the same time, upper web !2 is sealed to strip !8 at permanent seal 22, and the peelable seal is provided between sealant layers 30, 32 at the reduced thickness area, as shown in FIGS. 2 and 3.

Figure 5:
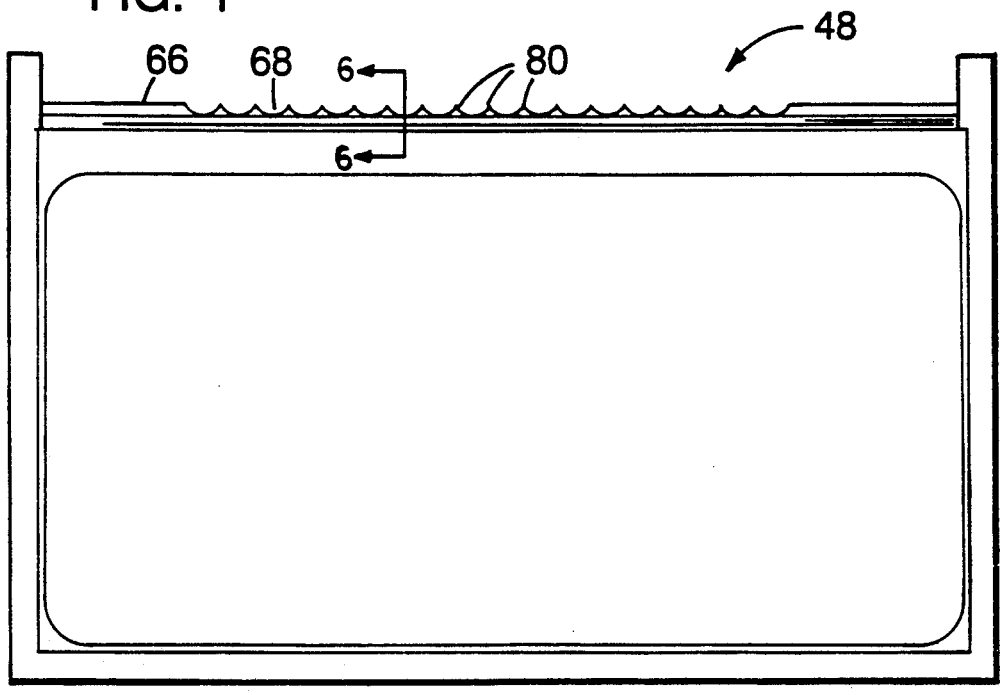
FIG. 5 is a plan view of a seal heating plate used in the FIG. 4 apparatus.
Figure 6:
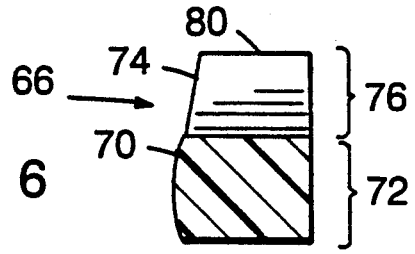
FIG. 6 is a partial sectional view, taken at 6—6 of FIG. 5, showing a crowned portion of the FIG. 5 plate.

Referring to FIG. 5, seal heating plate 48 is used at vacuum sealing station 64. It has front wall 66 that applies heat and pressure to upper web 12 over sealant layers 30, 32 while lower web 14 is supported in the conventional manner. The middle region of wall 66 has scalloped front edge 68, which is used to provide scalloped outside edge 38 of the reduced-thickness portion of package 10. Referring to FIG. 6, front wall 66 has crowned upper surface 70 at the rear over the portion 72 that extends along the length of the wall 66 and a gently sloping surface 74 over leading portions 76 that end at the point edges 80 of scalloped edge 68. Wall portion 66 is 6.0 mm wide (3.0 mm wide at portion 72 and 3.0 mm wide at portions 76), has a radius of 4.75 mm at surface 70, and slopes at a 3° angle at surface 74.

The use of crowned surface 70 results in a reduced thickness seal area that begins at a location near the apex of the crown and extends off to the two sides. This promotes increased pressure during the sealing step and reliably provides a substantial seal and avoids the generation of less reliable seal areas near the front and back edges of flat-topped walls of seal heating plates. The use of gently sloping surfaces 74 provides for increasing pressure from the points of the scalloped edge to the junctions of portions 72 and 76, resulting in an increase in seal strength from the leading tear edges 42 to the seal regions corresponding to the crowned surface area.

After sealing at station 64, the packages are separated from each other laterally by cutter bars and longitudinally by cutter rollers in cutting area 78.

A person opening package 10 grips webs !2, !4 at the middle region of open end 34 and pulls them apart. A leading tear edge or edges 42 near where the webs are gripped will be peeled apart first. The reduced area of the seal there permits the break in the seal to be initiated with small force, and, once the break has been initiated, it can be extended along the entire peelable seal with little force. Having a number of pointed leading edges 42 over a large central region facilitates opening regardless of where the person is gripping the webs along the central region. Because the seal can be opened with small force, a more aggressive seal can be provided by increasing the heat, time, and/or pressure, permitting formation of a strong and reliable seal, even when using materials with which it may be difficult to obtain reliable peelable seals.

Other embodiments of the invention are within the scope of the following claims. E.g., other materials can be used, and other shapes can be used to provide reduced area leading edges. There could be pointed, small width or blunt leading tear regions that are in front of portions of increasing width.

What is claimed is:

1. A resealable package comprising upper and lower webs defining a product containing area between them, said webs being permanently sealed to each other around the majority of the periphery of the product containing area and being temporarily and resealably sealed along the remainder of the periphery via a peelable seal between said two webs and an interlocking bead structure which effects an openable and reclosable seal between said two webs, said peelable seal being elongated and generally extending along a seal line, said webs having at said peelable seal in a direction perpendicular to said seal line an area of reduced thickness provided by a crowned seal heating plate so as to cause a reliable seal of increased strength at said area of reduced thickness, said area of reduced thickness gradually decreasing to a minimum thickness area from thicker areas on both sides thereof, said area of reduced thickness extending along the length of said seal line.

2. A resealable package comprising upper and lower webs defining a product containing area between them, said webs being permanently sealed to each other around the majority of the periphery of the product containing area, interlocking bead structure on said webs which effects an openable and reclosable seal between said two webs along the remainder of the periphery, and two sealant layers on opposing surfaces of said webs, said layers being elongated and generally extending along a seal line along said remainder of the periphery, said layers being sealed together at a peelable seal portion of said sealant layers having a defined shape providing a plurality of pointed leading tear edges so as to facilitate initiation of an opening along said peelable seal, said webs and layers having at said peelable seal in a direction perpendicular to said seal line an area of reduced thickness provided by a crowned seal heating plate so as to cause a reliable seal of increased strength at said area of reduced thickness, said area of reduced thickness gradually decreasing to a minimum thickness area from thicker areas on both sides thereof, said area of reduced thickness extending along the length of said seal line.

3. The package of claim 2 wherein said peelable seal is located outside of said interlocking bead structure.

4. The package of claim 3 wherein said interlocking bead structure is provided by zipper closure material including two strips that have been permanently sealed to respective said webs.

5. The package of claim 4 wherein said peelable seal is between said two strips.

* * * * *